US007020976B2

(12) United States Patent
Just

(10) Patent No.: US 7,020,976 B2
(45) Date of Patent: Apr. 4, 2006

(54) TOOL FOR INSTALLING SIDING

(75) Inventor: Wesley D. Just, Seattle, WA (US)

(73) Assignee: OfficeMax Incorporated, Boise, ID (US)

( * ) Notice: Subject to any disclaimer, the term of this patent is extended or adjusted under 35 U.S.C. 154(b) by 0 days.

(21) Appl. No.: 10/646,951

(22) Filed: Aug. 22, 2003

(65) Prior Publication Data

US 2004/0244214 A1 Dec. 9, 2004

Related U.S. Application Data

(60) Provisional application No. 60/476,529, filed on Jun. 5, 2003.

(51) Int. Cl.
*G01B 3/30* (2006.01)

(52) U.S. Cl. ..... 33/647

(58) Field of Classification Search ..... 33/646, 33/647, 648, 649

See application file for complete search history.

(56) References Cited

U.S. PATENT DOCUMENTS

| | | | | | |
|---|---|---|---|---|---|
| 248,460 | A | * | 10/1881 | Harris | 33/411 |
| 324,011 | A | * | 8/1885 | Danly | 33/646 |
| 888,985 | A | * | 5/1908 | Finn | 33/33 |
| 890,847 | A | * | 6/1908 | Dickman | 33/411 |
| 1,210,469 | A | * | 1/1917 | Harshberger | 33/648 |
| 1,448,787 | A | * | 3/1923 | Buck | 33/411 |
| 2,891,318 | A | * | 6/1959 | Harrison et al. | 33/648 |
| 3,490,152 | A | | 1/1970 | Printz | |
| 4,159,029 | A | | 6/1979 | Matthews | |
| 4,314,429 | A | | 2/1982 | Casteel et al. | |
| 4,425,714 | A | | 1/1984 | Kelly, Jr. | |
| 4,936,021 | A | * | 6/1990 | Frenette et al. | 33/649 |
| 5,291,719 | A | | 3/1994 | Buster | |
| 5,305,532 | A | * | 4/1994 | Johnson et al. | 33/647 |
| 5,319,909 | A | | 6/1994 | Singleterry | |
| 5,465,499 | A | | 11/1995 | LaPlante | |
| 5,522,149 | A | | 6/1996 | Meyer | |
| 5,623,767 | A | | 4/1997 | Colavito | |
| 5,836,113 | A | | 11/1998 | Bachman | |
| 5,921,058 | A | | 7/1999 | Brooker | |

(Continued)

FOREIGN PATENT DOCUMENTS

| | | | | |
|---|---|---|---|---|
| DE | 3406510 | A | * | 8/1985 |

(Continued)

OTHER PUBLICATIONS

The Labor Saver website, www.thelaborsaver.com (4 pages) (Aug. 22, 2003).

(Continued)

*Primary Examiner*—R. Alexander Smith
(74) *Attorney, Agent, or Firm*—Klarquist Sparkman

(57) ABSTRACT

A tool for installing siding, such as horizontally-disposed, overlapping siding is disclosed. In one embodiment, the tool comprises an elongate longitudinal portion having top and bottom end portions. A top siding-engaging portion extends from the top end portion and a bottom siding-engaging portion extends from the bottom end portion of the portion. A siding-support portion also extends from the longitudinal portion. In use, the tool may be pushed onto a first piece of siding to cause the top siding-engaging portion to frictionally engage a top transverse edge of the piece of siding and the bottom siding-engaging portion to frictionally engage a bottom transverse edge of the piece of siding. The first piece of siding can then be placed at an appropriate position against a structure above a previously-installed, second piece of siding, so that the siding-support portion rests on the second piece of siding.

27 Claims, 4 Drawing Sheets

U.S. PATENT DOCUMENTS

| | | | |
|---|---|---|---|
| 6,367,160 | B1 | 4/2002 | Rempe |
| 6,378,223 | B1 | 4/2002 | Korich et al. |
| 6,434,853 | B1 | 8/2002 | Pyburn |
| 6,598,362 | B1 | 7/2003 | Hikai |

FOREIGN PATENT DOCUMENTS

DE 4442367 C * 9/1996

OTHER PUBLICATIONS

Advertisement for Easysider™ (1 page) (date unknown).
Gecko Gauge Owner's Manual (1 page) (date unknown).
Advertisement for Fiber-Cement Siding Guage (1 page) (date unknown).
Photograph of "Quick Sider" siding guage tool (Aug. 2003).
Knock off clip website, http://www.knockoffclip.com/, http://www.knockoffclip.com/specs.php?lang=en, http://www.knockoffclip.com/instructions.php?lang=en, 4 pages, publication date unknown.
Sales bulletin, BTC industries, "buytheclip", 1 page, publication date unknown.

* cited by examiner

TOOL FOR INSTALLING SIDING

CROSS-REFERENCE TO RELATED APPLICATION

The present application claims the benefit of U.S. Provisional Application No. 60/476,529, filed Jun. 5, 2003, which is incorporated herein by reference.

FIELD

The present invention concerns a tool for installing siding, such as on the exterior of a house, and methods for its use.

BACKGROUND

Horizontally-disposed, overlapping siding (known as lap siding or clapboard siding) for installation on the framework of a building structure is well known and in widespread use. Numerous tools and gauges have been design to assist in the installation of siding. One such tool, disclosed in U.S. Pat. No. 4,425,714, is adapted to fit over a top transverse edge of a top most previously-installed piece of siding. In use, multiple tools are placed along the top edge of the previously installed piece of siding such that the upper surfaces of the tools form a shelf for supporting another piece of siding in the next higher course in an overlapping manner with respect to the previously-installed piece of siding.

When installing siding, "end gaps" or spaces are created between horizontally adjacent boards within a course of siding, and also between the end of a board and an adjacent surface of the structure, such as a piece of trim to allow for expansion and contraction of the siding. Accurate sizing of end gaps is important to ensure satisfactory building envelope performance.

A conventional technique that is used to create end gaps involves temporarily installing an appropriately sized nail in the framework of the structure at the location where an end gap is to be created and positioning a siding board against the framework with one end abutting the nail. After the siding board is installed, the nail is removed from the framework and the end gap is filled with a filler material, such as caulking. A drawback of this technique is that the nail leaves a hole in the framework and any weather barrier or membrane material covering the framework. The filler material can eventually fail or deteriorate, making the structure susceptible to moisture intrusion via the holes created by the nails, especially in the areas adjacent to a protrusion, such as a piece of trim, or a fenestration, such as a window or door opening.

Thus, there is a continuing need for new and improved tools for installing siding.

SUMMARY

Disclosed are embodiments of a tool that allows for rapid and accurate installation of siding, such as horizontally-disposed, overlapping siding. The tool, according to one representative embodiment, is adapted to be frictionally retained on a piece of siding that is to be installed, but yet can be easily removed when the piece of siding is secured to the exterior of a building structure.

The tool in this embodiment includes an elongate longitudinal member having top and bottom end portions. A top siding-engaging member for frictionally engaging a top transverse edge of the piece of siding extends from the top end of the longitudinal member. A bottom siding-engaging member for engaging a bottom transverse edge extends from the bottom end portion of the longitudinal member. The top and bottom siding-engaging members are spaced apart from each other a fixed distance slightly less than the height of the piece of siding (i.e., the distance between top and bottom transverse edges of a piece of siding). To install, or mount, the tool on a piece of siding, the tool is typically placed so that it spans the height of the piece of siding. The tool is then pushed onto the piece of siding to cause the top siding-engaging member to frictionally engage a top transverse edge of the piece of siding and the bottom siding-engaging member to frictionally engage a bottom transverse edge of a piece of siding. The frictional engagement between the siding-engaging members and the edges of the piece of siding causes the tool to be retained on the piece of siding, yet allows an installer to easily remove the tool when the piece of siding is secured to a structure.

In particular embodiments, the tool further includes at least one siding-support member extending from the longitudinal member and disposed between the top and bottom siding-engaging members. When the tool is installed on a first piece of siding to be installed, the siding-support member can be placed on a top transverse edge of a previously-installed, second piece of siding in a lower course so that the first piece of siding is supported generally above the second piece of siding in an overlapping manner.

In certain embodiments, the top and bottom siding-engaging members are configured to engage an end portion of a piece of siding such that the longitudinal member is juxtaposed to an end edge of the piece of siding. Thus, when the tool is installed on an end portion of a piece of siding, the tool serves as a spacer between the end portion of the piece of siding and an adjacent surface on the structure (e.g., the end of a horizontally adjacent piece of siding). The tool thereby automatically creates an end gap between the end portion and the adjacent surface on the structure.

Certain embodiments of the tool are adapted to engage either end portion of a piece of siding. In one such embodiment, the top and bottom siding-engaging members each include respective first and second siding-engaging surfaces. When the tool is installed on a first end portion of a piece of siding, the first siding-engaging surfaces of the top and bottom siding-engaging members frictionally engage the top and bottom transverse edges of the piece of siding. When the tool is installed on a second end portion of the piece of siding, the second siding-engaging surfaces of the top and bottom siding-engaging members frictionally engage the top and bottom transverse edges of the piece of siding.

Certain embodiments of the tool include first and second siding-support members for supporting a piece of siding in a predetermined position for installation. When the tool is mounted on one end portion of a piece of siding to be installed, the first siding-support member supports the piece of siding on a previously-installed piece of siding in a lower course. When the tool is mounted on the opposite end portion of the piece of siding to be installed, the second siding-support member supports the piece of siding on the previously-installed piece of siding.

Additionally, certain embodiments of the tool include first and second gauge surfaces. The first and second gauge surfaces may be spaced apart a distance approximately equal to the desired exposure of the siding being installed. Such embodiments of the tool therefore can be used as an exposure/overlap gauge by positioning the first gauge surface against a bottom transverse edge of a piece of siding being installed and the second gauge surface against a bottom transverse edge of a previously-installed piece of siding in a lower course.

According to another representative embodiment, a tool for installing siding, is adapted to couple to an end portion of a piece of siding to be installed on a structure such that a surface of the tool is juxtaposed to an end edge of the end portion of the piece of siding. When coupled to the end portion of the piece of siding, the tool serves as a spacer to create an end gap between the end portion and an adjacent surface on the structure. In one embodiment, the tool comprises an elongate body and first and second siding-engaging portions extending from the body. When the tool is installed on an end portion of a piece of siding, the first siding-engaging portion frictionally engages a first transverse edge of the piece of siding and the second siding-engaging portion frictionally engages a second transverse edge of the piece of siding.

According to another representative embodiment, a method for installing siding, such as horizontally-disposed, overlapping siding on a structure, includes coupling a removable siding-installation tool to a first piece of siding such that the tool engages top and bottom transverse edges of the first piece of siding. The tool is then supported on a previously-installed, second piece of siding of a lower course such that the first piece of siding is supported in an overlapping relationship with respect to the second piece of siding. As the first piece of siding is supported by the tool, an installer can secure the first piece of siding to the structure.

According to another representative embodiment, a method for installing siding, such as horizontally-disposed, overlapping siding on a structure, includes securing a removable siding-installation tool to an end portion of a piece of siding that is to be installed on the structure. The piece of siding is then positioned for installation such that the tool abuts an adjacent surface on the structure, thereby creating an end gap between the end portion of the piece of siding and the adjacent surface.

DETAILED DESCRIPTION

As used herein, the singular forms "a," "an," and "the" refer to one or more than one, unless the context clearly dictates otherwise.

As used herein, the term "includes" means "comprises."

As used herein, a group of individual members stated in the alternative includes embodiments relating to a single member of the group or combinations of multiple members. For example, the term "a, b, or c," includes embodiments relating to "a," "b," "c," "a and b," "a and c," "b and c," and "a, b, and c."

Figure 1:
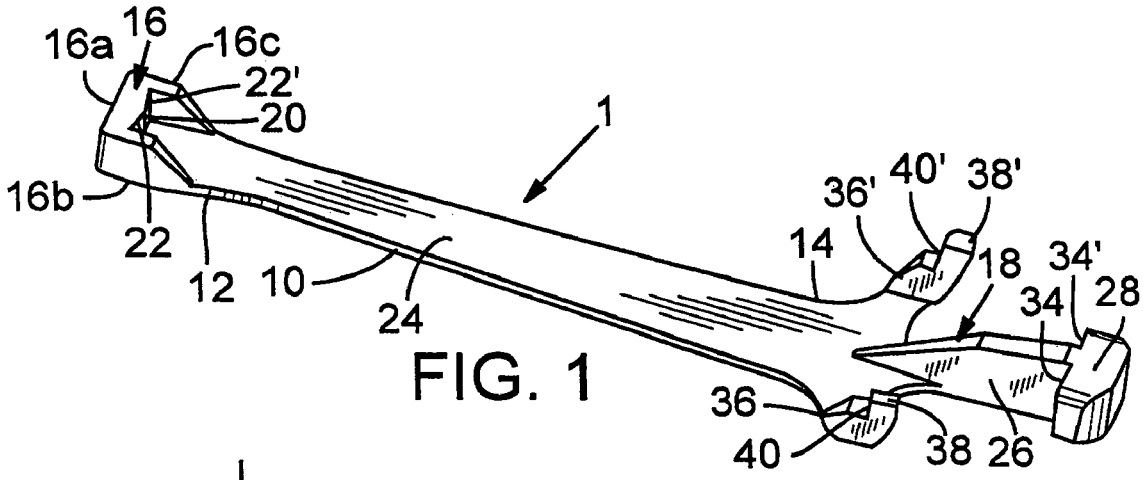
FIG. 1 is a perspective view of a siding-installation tool according to one embodiment.
Figure 2:
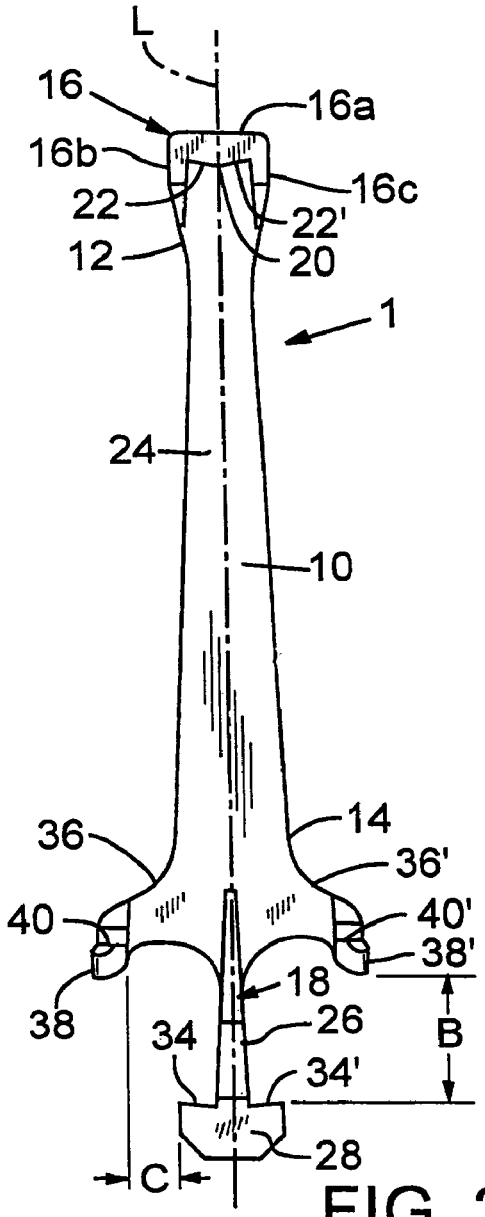
FIG. 2 is a front elevation view of the siding-installation tool of FIG. 1.
Figure 3:
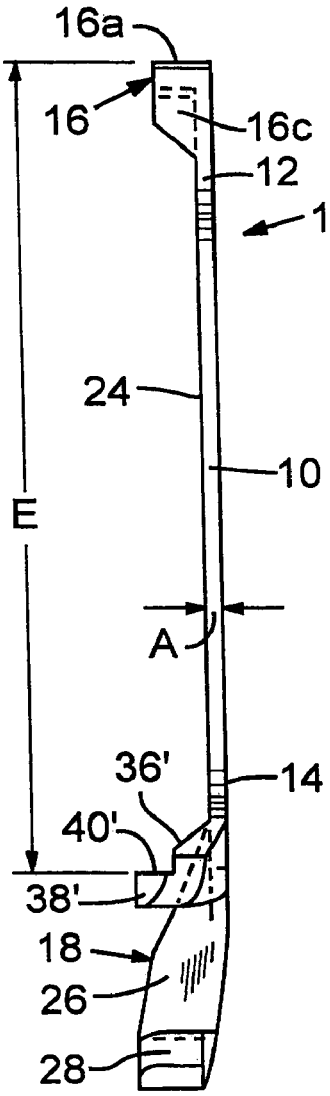
FIG. 3 is a side elevation view of the siding-installation tool of FIG. 1.

Referring first to FIGS. 1–3, there is shown a siding-installation tool 1, according to one embodiment, that may be used to install siding, such as horizontally-disposed, overlapping pieces of siding, on the framework of a structure. The siding-installation tool 1 can be made of any suitable material, such as, but not limited to, metals, alloys, polymers, composite materials, and various other materials. In particular embodiments, the siding-installation tool 1 is made of a tool-grade polymer, because of its strength, durability, low weight, and ease of manufacture.

The tool 1 in the illustrated configuration comprises an elongate main body or longitudinal portion 10 having an upper, or top end portion 12 and a lower, or bottom end portion 14. A top siding-engaging portion 16 extends from the top end portion 12 for frictionally engaging a top transverse edge of a piece of siding to be installed. A bottom siding-engaging portion 18 extends from the bottom end portion 14 for frictionally engaging a bottom transverse edge of a piece of siding to be installed.

In use, the top and bottom siding-engaging portions 16, 18, respectively, frictionally retain the siding-installation tool 1 on an end portion of a piece of siding to be installed such that an inner surface 24 of the tool is juxtaposed to an end edge of the piece of siding (i.e., the inner surface 24 is generally in a face-to-face relationship with respect to the end edge of a piece of siding). When the tool is coupled to an end portion of a piece of siding in this manner, the tool 1 supports the respective end portion of the piece of siding in a predetermined position for installation and sets the end gap at the supported end of the piece of siding. As best shown in FIG. 2, the illustrated siding-installation tool 1 is generally symmetrical with respect to an imaginary line L extending in the longitudinal direction (i.e., in the direction of the length of the tool 1) so that the tool 1 can be mounted on either end portion of a piece of siding. Uses of the siding-installation tool 1 are described in greater detail below.

As shown in FIGS. 1 and 2, the top siding-engaging portion 16 in the illustrated embodiment is a generally U-shaped member having a top portion 16*a* and downwardly extending side portions 16*b* and 16*c*. The top portion 16*a* has a siding-engaging surface 20. As best shown in FIG. 2, the siding-engaging surface 20 can be formed with two inclined or angled siding-engaging surfaces 22 and 22'. The bottom siding-engaging portion 18 in the illustrated embodiment includes an extension, or leg portion 26 extending generally downwardly from the bottom end portion 14 of the longitudinal portion 10 and terminates in an end portion 28. The end portion 28 is formed with first and second siding-engaging surfaces 34, 34', extending from opposite sides of the leg portion 26.

Figure 4A:
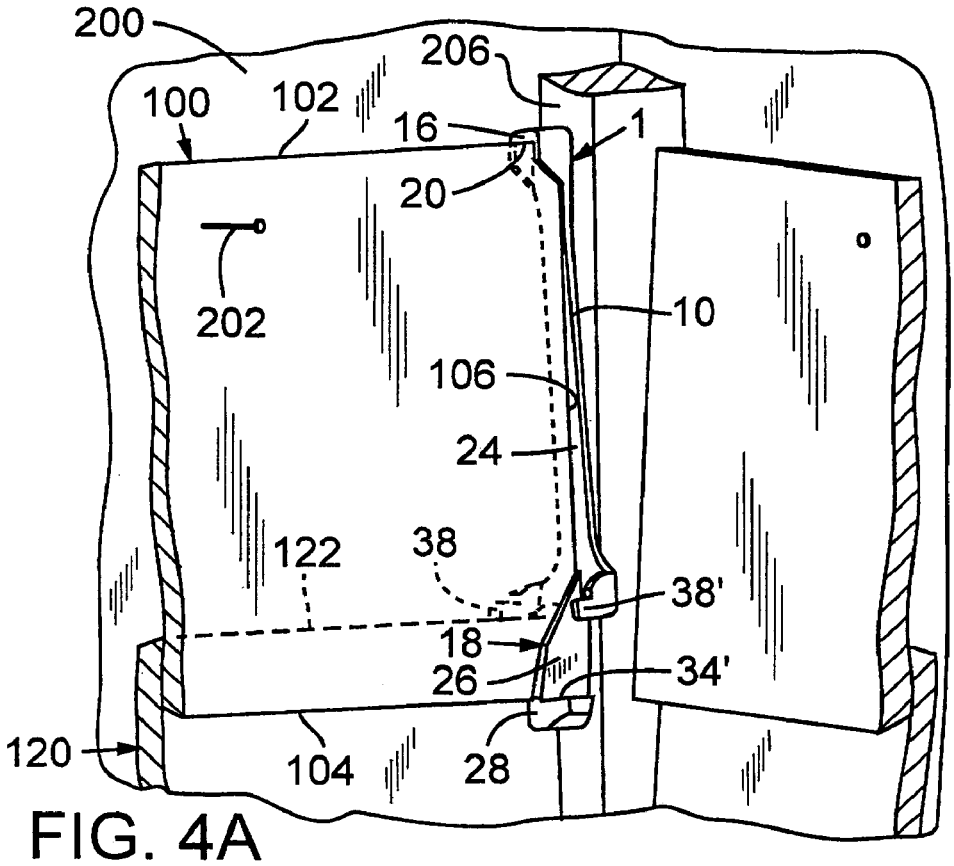
FIG. 4A is a perspective view showing the siding-installation tool of FIG. 1 being used to install a piece of siding adjacent to an existing piece of trim on a structure.
Figure 4B:
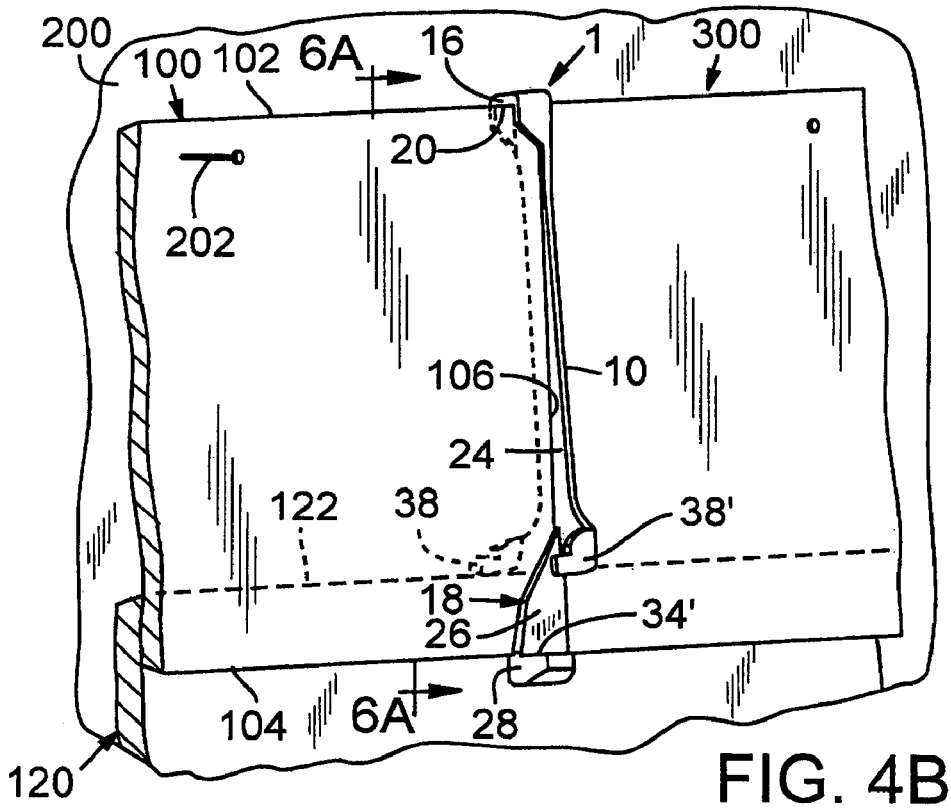
FIG. 4B is a perspective view similar to FIG. 4A showing the siding-installation tool of FIG. 1 being used to install a piece of siding next to a previously-installed piece of siding in the same course.
Figure 6A:
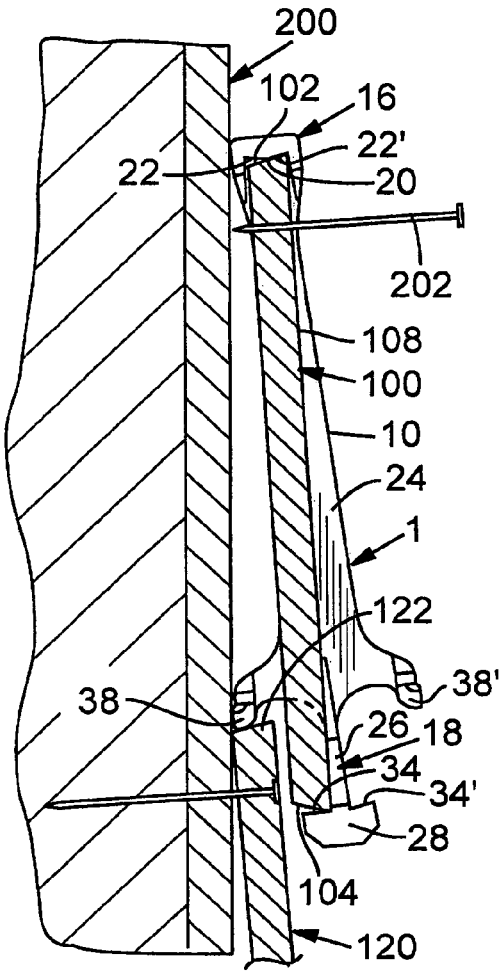
FIG. 6A is a cross-sectional view of the structure shown in FIG. 4B taken along line 6A—6A of FIG. 4B.

The illustrated tool 1 can be mounted on either end portion of a piece of siding. For example, when the tool 1 is installed on the right-hand end portion of a piece of siding 100 (that is, the right-hand end portion when facing the outwardly facing, exposed surface of the piece of siding 100), such as shown in FIGS. 4A, 4B, and 6A, the siding-engaging surface 22' of the top siding-engaging portion 16 frictionally engages a top transverse edge 102 of the piece of siding 100, and the siding-engaging surface 34 of the bottom siding-engaging portion 18 frictionally engages a bottom transverse edge 104 of the piece of siding. Although not shown in the drawings, when the tool 1 is installed on the opposite end portion of the piece of siding 100 (the left-hand end portion when facing the exposed surface of the piece of siding 100), the siding-engaging surface 22 of the top siding-engaging portion 16 frictionally engages a top transverse edge 102 of the piece of siding, and the siding-engaging surface 34' of the bottom siding-engaging portion 18 frictionally engages a bottom transverse edge 104 of the piece of siding.

The spacing between siding-engaging surfaces 22' and 34 and between siding-engaging surfaces 22 and 34' may be slightly less than the height of a piece of siding so that the tool 1 can be frictionally retained on an end portion of the piece of siding, but yet can be easily removed by an installer after the piece of siding is adequately secured on a structure. In the illustrated embodiment, the tool 1 is shown being used to install siding having top and bottom transverse edges 102 and 104, respectively, that taper from the exposed front face to the rear face of the siding. The siding-engaging surfaces 22, 22', 34, and 34' may be angled to generally correspond to the taper of the top and bottom transverse edges 102, 104 of a piece of such siding to ensure that the siding-engaging surfaces create a gripping force sufficient to retain the tool 1 while the piece of siding is being installed. In other embodiments, however, siding-engaging surface 22 can be co-planar with siding-engaging surface 22' (i.e., siding-engaging surface 20 would be flat), and siding-engaging surface 34 can be co-planar with siding-engaging surface 34', such as for installing siding having a rectangular cross-sectional profile.

As shown in FIG. 3, the longitudinal portion 10 has a thickness A that defines the width of the end gap between an end portion of a piece of siding supported by the tool 1 and an adjacent existing surface on the structure. As further described below, the existing surface can be, for example, an end edge of a horizontally adjacent piece of siding in the same course of siding, a piece of trim or molding, or the casing of a door or window.

Embodiments of the siding-installation tool 1 can also include at least one siding-support portion for supporting a piece of siding to be installed generally above a previously-installed piece of siding in a lower course in an overlapping relationship therewith. As shown in FIGS. 1–3, for example, the illustrated siding-installation tool 1 includes first and second siding-support portions 36, 36' extending generally laterally from the bottom end portion 14 of the longitudinal portion 10. Each siding-support portion 36, 36' is formed with a respective support arm 38, 38'. As shown in FIG. 6A, when the siding-installation tool 1 is installed on the right-hand end portion of a piece of siding 100, support arm 38 is supported on a top transverse edge 122 of a previously-installed piece of siding 120 in a lower course. In a similar manner, when the siding-installation tool 1 is installed on the left-hand end portion of the piece of siding 100, support arm 38' is supported on the top transverse edge 122 of the previously-installed piece of siding 120.

Figure 6B:
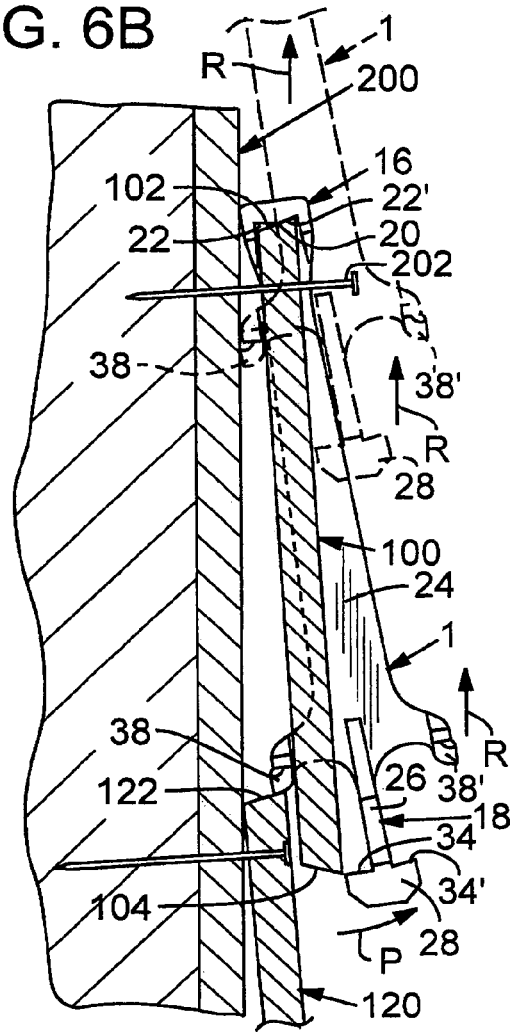
FIG. 6B is a view similar to FIG. 6A showing the siding-installation tool being removed from a piece of siding.

As shown in FIG. 2, the lower surfaces of support arms 38, 38' are spaced from the siding-support surfaces 34, 34' a distance B in the longitudinal direction. The distance B defines the amount of overlap between a piece of siding being installed and a previously-installed piece of siding in a lower course. In addition, the support arms 38, 38' are laterally spaced from their corresponding siding-engaging surfaces 34, 34' a distance C that is greater than the thickness of the siding to permit removal of the siding-installation tool 1. More specifically, and referring to FIG. 6B, after a piece of siding 100 is secured to a structure 200, but prior to applying nails (or other suitable fasteners) to the end portion that is supported by the tool 1, the tool 1 is removed from the piece of siding 100 by first pulling the end portion 28 generally away from the piece of siding, as indicated by arrow P, until the siding-engaging surface 34 clear the bottom transverse edge 104 of the piece of siding. Once the siding-engaging surface 34 is clear of the bottom transverse edge 104, the tool 1 can be removed by sliding the tool 1 generally upwardly, as indicated by arrow R, until support arm 38 clears the top transverse edge 102 of the piece of siding. Thereafter, the tool can be re-used to install the next piece of siding.

Figure 5:
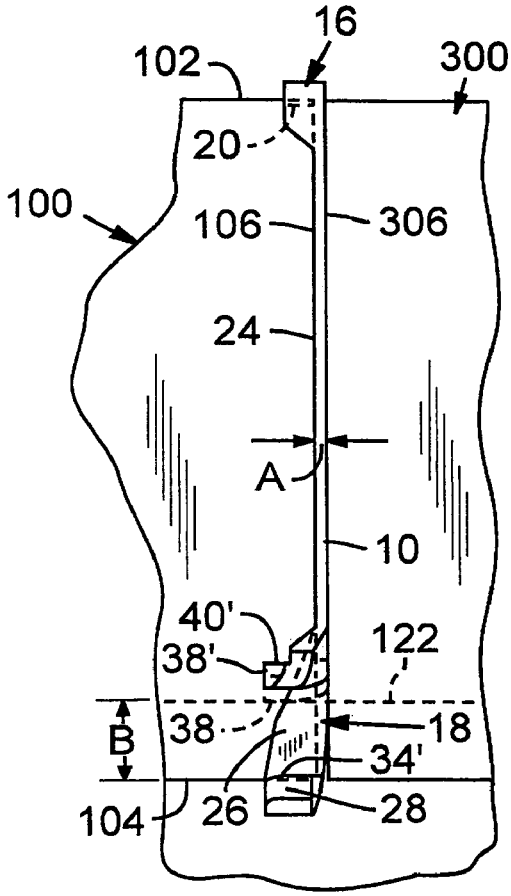
FIG. 5 shows the siding-installation tool of FIG. 1 being used as an overlap/exposure gauge to set the exposure of a previously-installed piece of siding as another piece of siding is being installed above the previously-installed piece of siding.

Embodiments of the siding-installation tool 1 also can be configured for use as a siding-exposure/overlap gauge to assist in maintaining the proper overlap of a piece of siding that is being installed. According to one embodiment, the support arms 38, 38' can be formed with respective gauge surfaces 40 and 40' that are spaced from the top surface of top portion 16*a* (which serves as another gauge surface) by a distance E (FIG. 3) that is approximately equal to the exposure of each piece of siding when installed. FIG. 5 illustrates the use of the siding-installation tool 1 as an exposure/overlap gauge. As shown, as a piece of siding 100 is being installed above a previously-installed piece of siding 120 in a lower course, the tool is held against the previously-installed piece of siding 120 such that the gauge surfaces 40, 40' are underneath its bottom transverse edge 124 and the bottom transverse edge 104 of the piece of siding 100 is supported on the top portion 16*a*, thereby simultaneously setting the proper exposure E of the previously-installed piece of siding 120 and the overlap of the piece of siding 100 that is being installed.

Figure 4C:
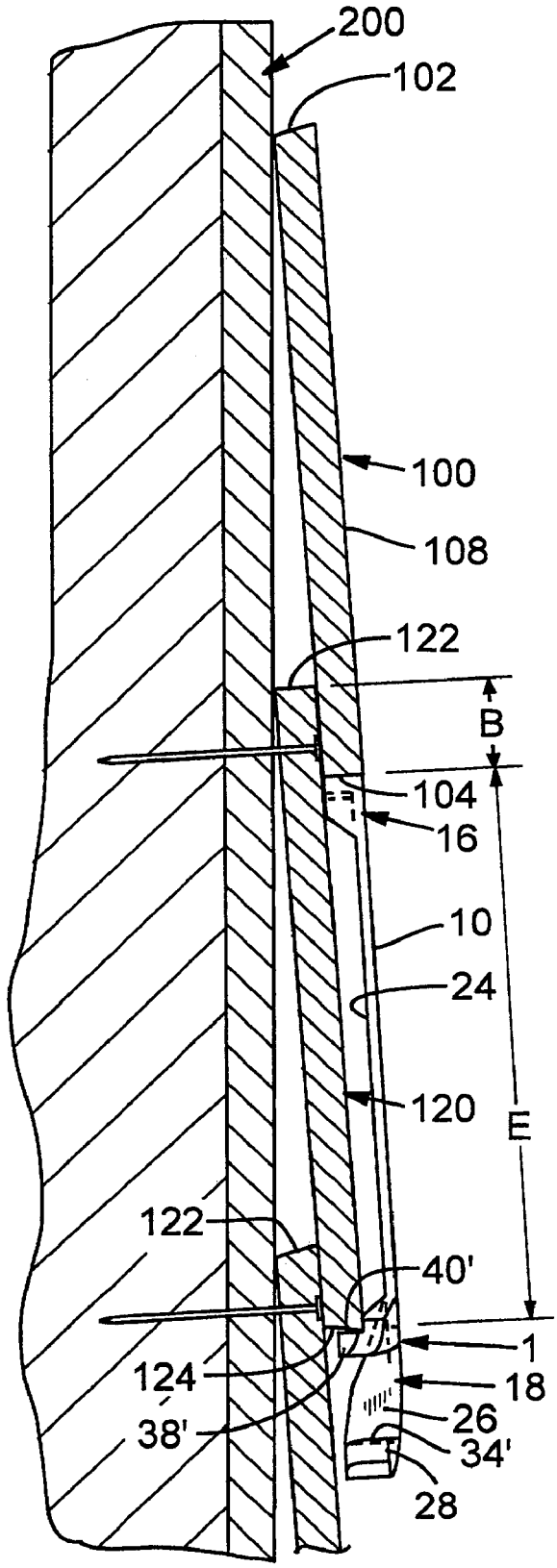
FIG. 4C is a front view of the installation process shown in FIG. 4B, illustrating the siding-installation tool being used to create an end gap between the two pieces of siding.

According to one embodiment of the disclosed methods for installing siding on a structure, the first course of siding is first installed on the structure. In some installations, a starter strip can be installed prior to the first course of siding, as known in the art. After the first course of siding is installed, a siding-installation tool 1 is secured to an end portion of a piece of siding to be installed in the second course. In the example shown in FIGS. 4B, 4C, and 6A, the tool 1 is secured to the right-hand end portion of a piece of siding 100 that is to be installed over a previously-installed piece of siding 120 in a lower course.

With the tool 1 secured to the right-hand end portion of the piece of siding 100, an installer positions the piece of siding 100 against the structure 200 such that the support arm 38 is supported on the top transverse edge 122 of the previously-installed piece of siding 120 of the lower course and the longitudinal portion 10 of the tool 1 abuts an adjacent surface on the structure 200. The adjacent surface can be the end edge of a horizontally adjacent piece of siding 300 in the same course (FIGS. 4B and 4C), a piece of molding or trim 206 on the structure (FIG. 4A), the casing around a window or door, or some other surface on the structure 200. In any event, the tool 1 automatically sets the end gap between the right-hand end portion of the piece of siding 100 and the adjacent surface. After each piece of siding is installed on the structure, the end gaps in each course of siding can be filled with a suitable filler material, such as caulking, as known in the art.

To ensure that the overlap of the piece of siding 100 (and therefore the exposure of the previously-installed piece of siding 120) is substantially uniform across the entire length of the piece of siding, the overlap can be set at a position spaced from the right-hand end portion of the piece of siding (e.g., at the middle of the length of the piece of siding 100) using a second siding-installation tool 1 in the manner illustrated in FIG. 5 (i.e., using a separate tool 1 as an overlap/exposure gauge).

While the piece of siding 100 is supported by the tool 1 on the previously-installed piece of siding 120, the installer secures the piece of siding 100 to the structure 200 using nails 202 (or other suitable fasteners). In one approach, for example, the installer starts nailing at about the middle of the length of the piece of siding 100 and gradually works toward the left-hand end portion of the piece of siding 100. After two or more nails 202 are hammered into the piece of siding 100, the tool 1 can be removed from the piece of siding 100 in the manner described above and illustrated in FIG. 6B. The tool 1 can be used later to install the next piece of siding. After securing the left half of the piece of siding 100 to the structure 200, the installer can then secure the right half of the piece of siding to the structure 200, starting at the middle of the length and gradually working toward the right-hand end portion, for example. This process is then repeated for each additional piece of siding installed on the structure 200. In alternative embodiments, the manner in which the nails or other fasteners are installed can be modified as desired. For example, the piece of siding 100 can be secured to the structure 200 by first nailing the left-hand end portion of the piece of siding and gradually working toward the right-hand end portion.

The foregoing process of installing siding can be accomplished by only one installer. In addition, as noted above, the tool 1 can be secured to either the right-hand end portion, the left-hand end portion, or both end portions of a piece of siding. Accordingly, the foregoing process can just as easily be accomplished by installing the siding-installation tool 1 on the left-hand end portion of the piece of siding 100, rather than on the right-hand end portion, as described above. In another approach, a respective siding-installation tool 1 can be secured to both end portions of the piece of siding 100 to support both end portions on the previously-installed piece of siding 120.

While the illustrated siding-installation tool 1 is shown as being configured for use on either end portion of a piece of siding, this is not a requirement. In other embodiments, for example, a siding-installation tool can be adapted to be installed on the right-hand end portion of a piece of siding. Such a tool can have siding-engaging surface 22', siding-engaging surface 34, and siding-support portion 36, while siding-engaging surface 22, siding-engaging surface 34' and siding-support portion 36' can be optional. Similarly, a siding-installation tool adapted to engage the left-hand end portion of a piece of siding can have siding-engaging surface 22, siding-engaging surface 34', and siding-support portion 36', while siding-engaging surface 22', siding-engaging surface 34 and siding-support portion 36 can be optional.

The present invention has been shown in the described embodiments for illustrative purposes only. The present invention may be subject to many modifications and changes without departing from the spirit or essential characteristics thereof. I therefore claim as my invention all such modifications as come within the spirit and scope of the following claims.

I claim:

1. A tool for installing a first piece of siding over a previously-installed, second piece of siding in an overlapping relationship, the tool comprising:

an elongate longitudinal member comprising top and bottom end portions;

a top siding-engaging member extending from the top end for engaging a top transverse edge of the first piece of siding; and a bottom siding-engaging member extending generally from the bottom end portion for engaging a bottom transverse edge of the first piece of siding, the top and bottom siding-engaging member being spaced apart from each other a fixed distance such that, whenever the first piece of siding is disposed between the top and bottom siding-engaging members, the top and bottom siding-engaging members frictionally engage the top and bottom transverse edges, respectively, of the first piece of siding to retain the tool on the first piece of siding.

2. The tool of claim 1, wherein the top and bottom siding-engaging members are configured to engage an end portion of the first piece of siding such that the longitudinal member is juxtaposed to an end edge of the first piece of siding whenever the first piece of siding is disposed between the top and bottom siding-engaging members.

3. The tool of claim 2, wherein the longitudinal member has a thickness dimensioned to establish a predetermined end gap at the end edge of the first piece of siding.

4. The tool of claim 2, wherein said end portion comprises a first end portion and the bottom siding-engaging member comprises first and second siding-engaging surfaces configured such that the first siding-engaging surface engages a bottom transverse edge of the first piece of siding when the tool is installed on the first end portion of the first piece of siding and the second siding-engaging surface engages a bottom transverse edge of the first piece of siding when the tool is installed on a second end portion of the first piece of siding.

5. The tool of claim 1, further comprising at least one siding-support member extending from the longitudinal member and disposed between the top and bottom siding-engaging members, the siding-support member being configured to support the first piece of siding above the second piece of siding in an overlapping manner.

6. The tool of claim 5, wherein:

the top and bottom siding-engaging members are configured to engage an end portion of the first piece of siding such that the longitudinal member is juxtaposed to an end edge of the first piece of siding; and the at least one siding-support member comprises first and second siding-support members configured such that the first siding-support member supports the first piece of siding above the second piece of siding when the tool is installed on a first end portion of the first piece of siding, and the second siding-support member supports the first piece of siding above the second piece of siding when the tool is installed on a second end portion of the first piece of siding.

7. The tool of claim 5, wherein the at least one siding-support member is longitudinally spaced from the bottom siding-engaging member a distance approximately defining the overlap between the first piece of siding and the second piece of siding.

8. The tool of claim 5, wherein the at least one siding-support member is spaced laterally from the bottom siding-engaging member a distance approximately greater than the thickness of the first piece of siding to permit removal of the tool from the first piece of siding after the first piece of siding is secured to a structure.

9. The tool of claim 5, wherein:

the at least one siding-support member has an upper and lower surface, the lower surface being longitudinally spaced from the bottom siding-engaging member a distance equal to a desired overlap between the first piece of siding and the second piece of siding; and the top siding-engaging member has an upper surface, the upper surface of the siding-support member being longitudinally spaced from the upper surface of the top siding-engaging member a distance equal to a desired exposure of the second piece of siding.

10. The tool of claim 1, further comprising a first gauge surface and a second gauge surface spaced from the first gauge surface a distance approximately equal to the exposure of the second piece of siding, the first gauge being adapted to abut the bottom transverse edge of the first piece of siding and the second gauge surface being adapted to abut a bottom transverse edge of the second piece of siding.

11. A tool for installing siding, the tool comprising non-movable, first and second siding-engaging portions being at fixed, non-adjustable locations with respect to each other, the tool being adapted to couple to an end portion of a piece of siding by sliding the first and second siding-engaging portions onto first and second transverse edges of the piece of siding and such that a surface of the tool is juxtaposed to a vertical end surface of the end portion.

12. The tool of claim 11 comprising an elongate body, the first and second siding-engaging portions extending from the body, the second siding-engaging portion being spaced from the first siding-engaging portion such that the first siding-engaging portion frictionally engages the first transverse edge of the piece of siding and the second siding-engaging portion frictionally engages the second transverse edge of the piece of siding to retain the tool on the end portion of the piece of siding.

13. The tool of claim 11 comprising a siding-support portion for supporting the piece of siding above a previously-installed piece of siding in a lower course in an overlapping manner.

14. A tool for installing siding, the tool being adapted to couple to an end portion of a piece of siding by engaging first and second transverse edges of the piece of siding and such that a surface of the tool is juxtaposed to an end edge of the end portion wherein the tool creates an end gap between the end edge of the piece of siding and an adjacent surface on the structure when the tool is installed on the end portion and the piece of siding is secured to a structure.

15. The tool of claim 14, wherein the tool has a thickness that approximately defines the width of the end gap.

16. A tool for installing a piece of siding having first and second end portions, the tool comprising:

an elongate body having first and second end portions, and first and second siding-engaging surfaces extending from opposite sides of the first end portion, the first and second siding engaging surfaces being non-parallel to each other and non-perpendicular to a longitudinal axis of the body; and wherein when the tool is installed on the first end portion, the first siding-engaging surface frictionally engages a transverse edge of the first end portion, and when the tool is installed on the second end portion, the second siding-engaging surface frictionally engages a transverse edge of the second end portion.

17. A tool for installing siding that has first and second opposing end portions, the tool being adapted to couple to an end portion of a piece of siding such that a surface of the tool is juxtaposed to an end edge of the end portion, the tool comprising:

a first siding-engaging surface and a second siding-engaging surface, wherein when the tool is installed on the first end portion, the first siding-engaging surface frictionally engages a transverse edge of the first end portion, and when the tool is installed on the second end portion, the second siding-engaging surface frictionally engages a transverse edge of the second end portion; and a first siding-support portion and a second siding-support portion, the first siding-support portion being configured to support the first end portion of the piece of siding above a previously-installed piece of siding when the tool is installed on the first end portion, the second siding-support portion being configured to support the second end portion of the piece of siding above a previously-installed piece of siding when the tool is installed on the second end portion.

18. The tool of claim 17, wherein the first siding-support portion is laterally spaced from the first siding-engaging surface a predetermined distance, and the second siding-support portion is laterally spaced from the second siding-engaging surface by said predetermined distance.

19. The tool of claim 17, wherein the tool is generally symmetrical with respect to a line extending longitudinally through the tool, wherein the first siding-support portion and the first siding-engaging surface are on the one side of the line, and the second siding-support portion and the second siding-engaging surface are on the opposite side of the line.

20. A tool for installing horizontally-disposed, overlapping siding on a structure, the tool comprising a body configured to couple to an end portion of a piece of siding to be installed, the body having an inner surface extending the majority of the height of the piece of siding, such that when the tool is coupled to the end portion, the inner surface contacts an end edge of the end portion and when the piece of siding is placed against the structure and the body is positioned between the end portion and a horizontally adjacent surface on the structure, a gap is created between the end portion and the adjacent surface.

21. The tool of claim 20, wherein the body comprises an elongate longitudinal portion defining the inner surface and being juxtaposed to an end edge of the end portion when the tool is installed on the end portion of the piece of siding, the longitudinal portion having a thickness that approximately defines a width of the gap when the piece of siding is installed on the structure.

22. The tool of claim 20, further comprising at least one siding-support portion extending from the body, the siding-support portion being configured to support the piece of siding to be installed above a previously-installed piece of siding.

23. A tool for installing horizontally-disposed, overlapping siding on a structure, the tool comprising a body configured to couple to an end portion of a piece of siding to be installed such that when the piece of siding is placed against the structure and the body is positioned between the end portion and a horizontally adjacent surface on the structure, a gap is created between the end portion and the adjacent surface, wherein the body comprises:

a top end portion and a bottom end portion;

a top siding-engaging member extending from the top end portion of the body for engaging a top transverse edge of the end portion of the piece of siding; and a bottom siding-engaging member extending from the bottom end portion of the body for engaging a bottom transverse edge of the end portion of the piece of siding, the top and bottom siding-engaging member being spaced apart from each other such that the top and bottom siding-engaging members frictionally engage the top and bottom transverse edges, respectively, of the end portion of the piece of siding to retain the tool on the piece of siding.

24. A method for installing horizontally-disposed, overlapping siding on a structure, the method comprising:

coupling a siding-installation tool to a first piece of siding that is to be installed on the structure, the tool engaging top and bottom transverse edges of the first piece of siding; and supporting the tool on a second piece of siding that has been previously installed on the structure such that the first piece of siding is supported in an overlapping relationship with the second piece of siding.

25. A method for installing horizontally-disposed, overlapping siding on a structure, the method comprising:

securing a siding-installation tool to an end portion of a first piece of siding that is to be installed on the structure, the tool being completely removable from the first piece of siding; a positioning the first piece of siding against the structure such that the tool abuts an adjacent surface on the structure, thereby creating an end gap between the end portion of the first piece of siding and the adjacent surface; and supporting the tool on a previously installed, second piece of siding when creating the end gap such that the first piece of siding is supported in an overlapping relationship with the second piece of siding.

26. A tool for installing a piece of siding on a structure, the piece of siding having first and second end portions, the tool comprising:

an elongate longitudinal portion having top and bottom end portions;

a top siding-engaging portion extending from the top portion of the longitudinal portion; and a bottom siding-engaging portion comprising a leg portion extending from the bottom portion of the longitudinal member and first and second siding-engaging surfaces extending from opposing sides of the leg portion;

wherein the tool is adapted to receive the first end portion of the piece of siding between the top siding-engaging portion and the first siding-engaging surface with the longitudinal portion juxtaposed to an end edge of the first end portion of the piece of siding, and to receive the second end portion of the piece of siding between the top siding-engaging portion and the second siding-engaging surface with the longitudinal portion juxtaposed to an end edge of the second end portion of the piece of siding.

27. A tool for installing a first piece of siding above a previously-installed, second piece of siding on a structure, the first piece of siding having first and second end portions, the tool comprising:

an elongate longitudinal portion having top and bottom end portions;

a top siding-engaging portion extending from the top portion of the longitudinal portion, the top siding-engaging portion comprising first and second siding-engaging surfaces extending at an angle with respect to each other;

a bottom siding-engaging portion comprising a leg portion extending from the bottom portion of the longitudinal portion and first and second siding-engaging surfaces extending from opposing sides of the leg portion, the first and second siding-engaging surfaces of the bottom siding-engaging portion extending at an angle with respect to each other;

wherein the first siding-engaging surfaces of the top and bottom siding-engaging portions are configured to frictionally engage top and bottom transverse edges of the first end portion of the first piece of siding to retain the tool on the first end portion as the first piece of siding is being installed, and the second siding-engaging surfaces of the top and bottom siding-engaging portions are configured to frictionally engage top and bottom transverse edges of the second end portion of the first piece of siding to retain the tool on the second end portion as the first piece of siding is being installed;

first and second siding-support portions extending from opposite sides of the longitudinal portion between the top and bottom end portions of the longitudinal portion, the first siding-support portion configured to support the first piece of siding above the second piece of siding when the tool is retained on the first end portion of the first piece of siding, the second siding-support portion configured to support the first piece of siding above the second piece of siding when the tool is retained on the second end portion of the first piece of siding; and a first gauge surface and a second gauge surface spaced from the first gauge surface a distance approximately equal to the exposure of the second piece of siding, the first gauge being adapted to abut a bottom transverse edge of the first piece of siding and the second gauge surface being adapted to abut a bottom transverse edge of the second piece of siding.

* * * * *